US006796550B2

(12) United States Patent
Mulvaney

(10) Patent No.: US 6,796,550 B2
(45) Date of Patent: Sep. 28, 2004

(54) HUMIDIFIER FILTER SERVICING AND WATER LEVEL INDICATOR

(75) Inventor: Patrick T. Mulvaney, Glen Allen, VA (US)

(73) Assignee: Hamilton Beach/Proctor-Silex, Inc., Glen Allen, VA (US)

( * ) Notice: Subject to any disclaimer, the term of this patent is extended or adjusted under 35 U.S.C. 154(b) by 93 days.

(21) Appl. No.: 10/217,673

(22) Filed: Aug. 13, 2002

(65) Prior Publication Data

US 2003/0034573 A1 Feb. 20, 2003

Related U.S. Application Data

(60) Provisional application No. 60/312,333, filed on Aug. 14, 2001, now abandoned.

(51) Int. Cl.[7] ..... B01F 3/04

(52) U.S. Cl. ..... 261/26; 261/30; 261/105; 261/107; 73/29.02; 73/335.07

(58) Field of Search ..... 261/DIG. 65, 26, 261/30, 96, 99, 105, 107, 129; 73/29.02, 335.07

(56) References Cited

U.S. PATENT DOCUMENTS

| | | | | |
|---|---|---|---|---|
| 3,253,820 A | | 5/1966 | Seil | |
| 3,598,370 A | | 8/1971 | Hoag | |
| 3,637,194 A | | 1/1972 | Swimmer et al. | |
| 3,671,023 A | | 6/1972 | Seil | |
| 3,811,661 A | | 5/1974 | Procter | |
| 3,914,349 A | | 10/1975 | Stipanuk | |
| 4,286,751 A | | 9/1981 | Fowler | |
| 4,822,533 A | | 4/1989 | Steiner et al. | |
| 4,932,218 A | | 6/1990 | Robbins | |
| 5,014,908 A | * | 5/1991 | Cox | 236/44 E |
| 5,037,583 A | | 8/1991 | Hand | |
| 5,037,586 A | | 8/1991 | Mehrholz et al. | |
| 5,061,405 A | | 10/1991 | Stanek et al. | |
| 5,252,260 A | | 10/1993 | Schuman | |
| 5,397,510 A | | 3/1995 | Clark | |
| 5,573,713 A | | 11/1996 | Tomasiak et al. | |
| 5,668,535 A | | 9/1997 | Hendrix et al. | |
| 5,759,451 A | | 6/1998 | Tomasiak et al. | |
| 5,783,117 A | | 7/1998 | Byassee et al. | |

(List continued on next page.)

FOREIGN PATENT DOCUMENTS

| | | |
|---|---|---|
| JP | 62-194147 | 8/1987 |
| JP | 6-300346 | 10/1994 |
| JP | 7-332733 | 12/1995 |

OTHER PUBLICATIONS

Hunter Fan Company, "The Healthy Humidifier plus—Model No. 33350", Product Catalog, Cover and 1st page, (Jan. 1, 1997), Memphis, TN.

Hamilton Beach/Proctor–Silex, Inc., "Hamilton Beach. Humidifier", Product Catalog, pp. 1–16, (Jul. 2000), website address: www.hamiltonbeach.com.

*Primary Examiner*—Scott Bushey

(74) *Attorney, Agent, or Firm*—Akin Gump Strauss Hauer & Feld, L.L.P.

(57) ABSTRACT

A humidifier includes a housing, a fan assembly, a wick assembly, a first humidity sensor, a second humidity sensor, and a controller. The housing has an air inlet, an air outlet, and a reservoir for holding water. The fan assembly creates an airflow through the housing from the inlet to the outlet. The wick assembly is in fluid communication with the water in the reservoir and extends into the airflow within the housing for adding moisture to the airflow. The first humidity sensor measures an ambient air relative humidity and produces a first signal corresponding to the ambient air relative humidity. The second humidity sensor measures an outlet air humidity and produces a second signal corresponding to the outlet air humidity. The controller is in electrical communication with the first and second humidity sensors. The controller receives the first and second signals and performs calculations to produce an output signal.

19 Claims, 2 Drawing Sheets

U.S. PATENT DOCUMENTS 5,903,223 A 5/1999 Howell
6,053,482 A 4/2000 Glenn et al.
6,237,899 B1 5/2001 Offir et al.
6,308,939 B2 10/2001 Offir et al.
6,427,984 B1 * 8/2002 Mulvaney et al. ..... 261/70
6,523,810 B2 * 2/2003 Offir et al. ..... 261/72.1
2002/0050656 A1 5/2002 Offir et al.

* cited by examiner

HUMIDIFIER FILTER SERVICING AND WATER LEVEL INDICATOR

CROSS-REFERENCE TO RELATED APPLICATIONS

This patent application claims priority from U.S. Provisional Patent Application No. 60/312,333, filed Aug. 14, 2001 and now expired, entitled "Humidifier Filter Change and Water Level Indicator," the subject matter of which is incorporated herein by reference.

BACKGROUND OF THE INVENTION

Humidifiers that make use of a float switch will de-energize a fan assembly and/or indicate an out-of-water condition as soon as the water level is insufficient to create enough buoyancy to activate the float switch. The float switch generally de-energizes the fan assembly well before all of the water is evaporated from the water reservoir of the humidifier. A wet or damp wick likely sits in standing water for an extended duration of time if water remains in the reservoir and on the wick after the fan is turned off. The damp reservoir and wick have the potential to create a stale humidifier.

BRIEF SUMMARY OF THE INVENTION

Briefly stated, the present invention is an evaporative humidifier. The humidifier includes a housing, a fan assembly, a wick assembly, a first humidity sensor, a second humidity sensor, and a controller. The housing has an air inlet, an air outlet, and a reservoir for holding water. The fan assembly creates an airflow through the housing from the inlet to the outlet. The wick assembly is in fluid communication with the water in the reservoir and extends into the airflow within the housing for adding moisture to the airflow. The first humidity sensor measures an ambient air relative humidity and produces a first signal corresponding to the ambient air relative humidity. The second humidity sensor measures an outlet air humidity and produces a second signal corresponding to the outlet air humidity. The controller is in electrical communication with the first and second humidity sensors, receives the first and second signals, and performs calculations to produce an output signal for controlling the operation of the humidifier.

BRIEF DESCRIPTION OF THE SEVERAL VIEWS OF THE DRAWINGS

The following detailed description of preferred embodiments of the present invention will be better understood when read in conjunction with the appended drawings. For the purpose of illustrating the invention, there is shown in the drawings an embodiment which is presently preferred. It is understood however, that the invention is not limited to the precise arrangements and instrumentalities shown. In the drawings.

DETAILED DESCRIPTION OF THE INVENTION

Figure 1:
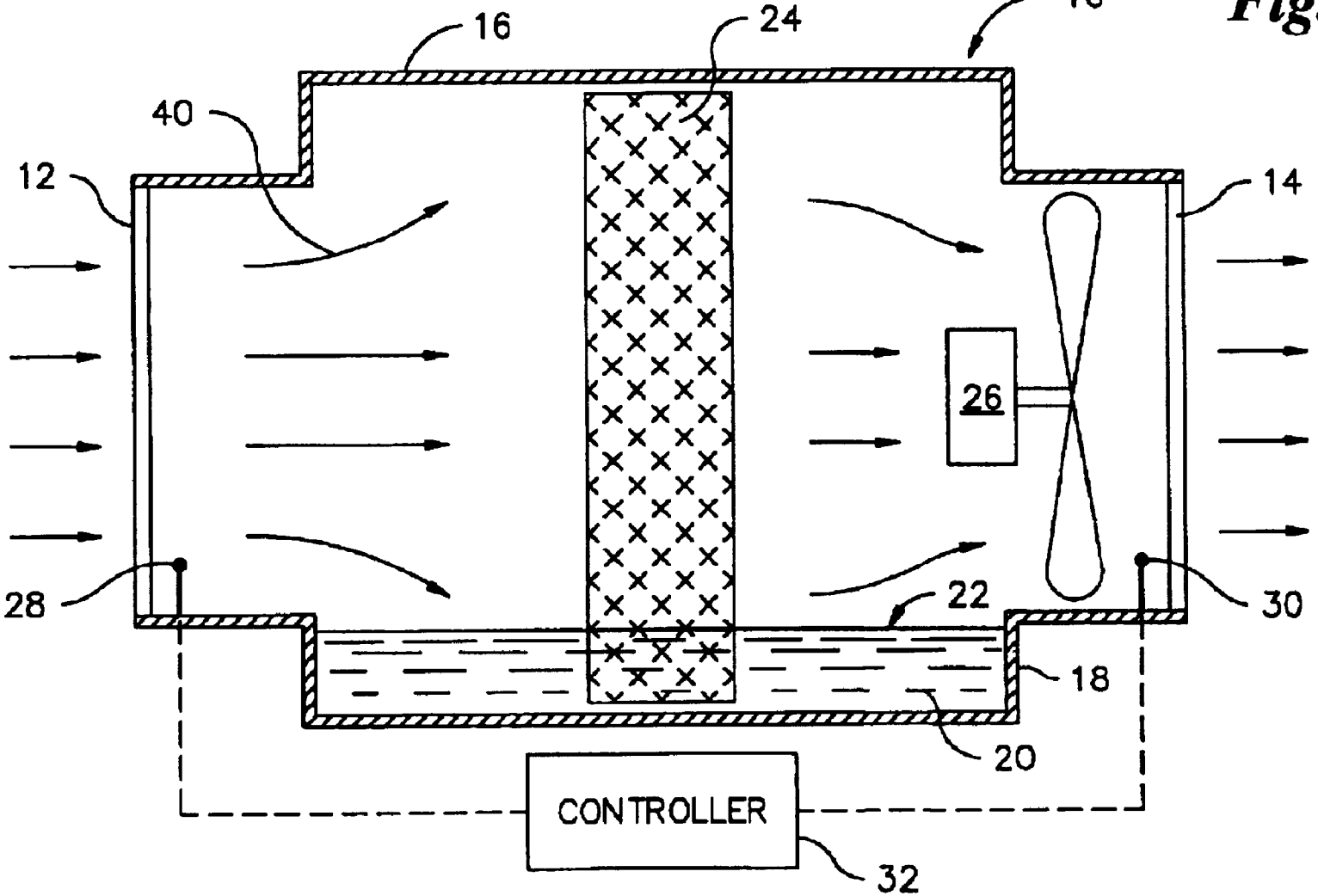
FIG. 1 is a side cross-sectional functional schematic view of a humidifier with humidity sensors in accordance with a preferred embodiment of the present invention.

Certain terminology is used in the following description for convenience only and is not limiting. The words "right," "left," "lower," and "upper" designate directions in the drawings to which reference is made. The words "inwardly" and "outwardly" refer to directions toward and away from, respectively, the geometric center of the humidifier and designated parts thereof. The terminology includes the words above specifically mentioned, derivatives thereof and words of similar import. Additionally, the word "a," as used in the specification, means "at least one."

FIG. 1 shows a humidifier, designated generally at 10, embodying the present. The humidifier 10 is comprised of a housing 16 with an air inlet 12, and an air outlet 14. Although the housing 16 is shown in FIG. 1 as having the air inlet 12 in line with the air outlet 14, the housing 16 is not limited to that configuration and can be shaped in some other manner such as with the air inlet 12 perpendicular to the air outlet 14. Also, although it is preferred that the housing 16 be made of a polymeric material, it is within the spirit and scope of the invention that the housing 16 be made of another material, such as a metallic alloy. The lower portion of the housing 16 contains or forms a water reservoir 18 and in the preferred embodiment will be supplied water 20 from a removable water tank (not shown). The lower end of an evaporative wick assembly 24 is in fluid communication with and preferably is located in the water reservoir 18 to absorb water 20 in a manner that is well known in the art. Air is blown through or sucked through the housing 16 by a fan assembly 26, creating an airflow 40 which enters the housing 16 through the air inlet 12, passes through the evaporative wick assembly 24, and exits the housing 16 through the air outlet 14. Although it is preferable that the fan assembly 26 be located downstream from the evaporative wick assembly 24 so as to suck air through the evaporative wick assembly 24, it is understood by those skilled in the art that the fan assembly 26 could be located at any point within the housing 16 or immediately outside either the air inlet 12 or air outlet 14 and oriented such that the fan assembly 26 can direct the airflow 40 in through the air inlet 12, through and around the evaporative wick assembly 24, and out through the air outlet 14. The airflow 40 passing through the evaporative wick assembly 24 absorbs water 20 from the evaporative wick assembly 24, thereby transferring the water 20 to the airflow 40 and thereafter to the surrounding atmosphere. Although it is preferred that the lower portion of the housing 16 contains the water reservoir 18, it is understood that the water reservoir 18 could be located anywhere within the housing 16, provided the evaporative wick assembly 24 is in fluid communication with the water reservoir 18. For example, the water reservoir 18 could be located at the top of the housing 16, and a portion of the evaporative wick assembly 24 could be located within the water reservoir 18 with the remainder of the evaporative wick assembly 24 extending down within the airflow 40. Alternatively, the water reservoir 18 could be located beside the evaporative wick assembly 24 with the evaporative wick assembly 24 extending sideways from the water reservoir 18 within the airflow 40.

The humidifier 10 of the preferred embodiment of the present invention also employs a first humidity sensor 28, preferably located proximate the air inlet 12 within the incoming air stream. The first humidity sensor 28 is not limited to placement in the incoming air stream and may be positioned at any location where a relative humidity of the room or environment where the humidifier 10 is located can be measured, for example, on an outer surface of the housing 16. The humidifier 10 of the present invention also employs a second humidity sensor 30, preferably located in the housing 16 proximate the air outlet 14 within the exiting air stream. Although the location of the second humidity sensor 30 within the housing 16 and proximate the air outlet 14 is preferable, it is understood by those skilled in the art that the second humidity sensor 30 could be located anywhere downstream of the evaporative wick assembly 24, including, but not limited to, proximate the outlet side of the evaporative wick assembly 24 or outside of the housing 16 within the airflow 40 exiting the air outlet 14.

The first and second humidity sensors 28, 30 function to measure humidity in the air in a manner well understood by those skilled in the art. Generally, the first and second humidity sensors 28, 30 sample the air that the first and second humidity sensors 28, 30 are located within and produce an electrical signal that is proportional to the amount of humidity within the air.

During normal operation, dry room air enters the humidifier housing 16 through the air inlet 12 and passes over the first humidity sensor 28 where the inlet air relative humidity is measured. The first humidity sensor 28 produces a first signal related to the inlet air relative humidity which is communicated to and received by a controller 32. After passing through the air inlet 12, the airflow 40 continues through the housing 16 and passes through and around the evaporative wick assembly 24. A portion of the evaporative wick assembly 24, preferably a lower end, is located in the water reservoir 18 to absorb water 20 and disperse it evenly over the surface of the evaporative wick assembly 24 above a water level top surface 22. As air passes through and around the wet evaporative wick assembly 24 the relatively dry air absorbs water from the evaporative wick assembly 24, which raises the relative humidity of the airflow 40. The more humid air continues through the housing 16 and passes over the second humidity sensor 30 where the outlet air relative humidity is measured and is exhausted through the air outlet 14. The second humidity sensor 30 produces a second signal related to the outlet air relative humidity which is electrically communicated to and received by the controller 32. The controller 32 then compares the received signals which reflect the inlet and outlet air relative humidities. The controller 32 can be a microprocessor, an application specific integrated circuit (ASIC), digital circuitry, or the like. It would be apparent to those skilled in the art how the controller 32 performs the described calculations.

During dry operation, when the humidifier water reservoir 18 is out of water, the relatively dry room air enters the housing 16 through the air inlet 12 and passes over the first humidity sensor 28 where the inlet air relative humidity is measured. The first humidity sensor 28 communicates the inlet air relative humidity signal to the controller 32. The airflow 40 continues through the housing 16 and passes through the dry evaporative wick assembly 24. The air relative humidity remains reasonably constant because the airflow 40 passing through the evaporative wick assembly 24 does not absorb water 20 or moisture from the evaporative wick assembly 24 because little or no water is present in the evaporative wick assembly 24. The relatively dry air continues through the housing 16, passes over the second humidity sensor 30 where the outlet air relative humidity is measured and is exhausted through the air outlet 14. The second humidity sensor 30 communicates the outlet air relative humidity signal to the controller 32, which compares the signals which reflect the inlet and outlet air relative humidities.

During operation, the difference in relative humidity measured by the second humidity sensor 30 and the first humidity sensor 28 is used as an out-of-water indicator, an output efficiency indicator, or a wick servicing indicator.

When used as an out of water indicator, the first and second humidity sensors 28, 30 are used to indicate the difference in relative humidity between the entrance air and the exit air to determine when the water reservoir 18 is dry. During normal operation, described above, there will be a relatively large difference in relative humidity measured between the second humidity sensor 30 and the first humidity sensor 28 due to the evaporation of water into the airflow 40. The controller 32 calculates the relatively large difference in relative humidity between the second humidity sensor 30 and the first humidity sensor 28. As the water 20 in the system is slowly consumed, the relative humidity difference between the entrance air and the exit air will gradually decrease until the dry operation situation is achieved and the relative humidity difference between the air exit humidity and the air entrance humidity approaches zero. The difference in relative humidity between the exit air humidity and the entrance air humidity is determined by the controller 32 by comparing the humidity measured by the first humidity sensor 28 and the second humidity sensor 30. When the dry operation situation is reached, the difference will be at or near zero, and a light or LED 34 and/or a buzzer 35 is actuated by the controller 32 to indicate to a user the dry operation situation. Alternatively, the calculated dry operation situation may prompt the controller 32 to turn off a power supply 38 which is used to provide power to the fan motor, thereby turning off the fan assembly 26. The methodology of using the first and second humidity sensors 28, 30 as out of water indicators described above has the added benefit of sensing when the water reservoir 18 and the evaporative wick assembly 24 are fully dried before de-energizing the fan assembly 26. This desiccating feature creates a relatively dry environment within the humidifier 10. A dry environment within the humidifier 10 is favorable for maintaining a fresh humidifier. A dry environment in the water reservoir 18 and on the evaporative wick assembly 24 also increases the usable life of the evaporative wick assembly 24.

The first humidity sensor 28 and second humidity sensor 30 are also used to determine a degradation of the exit air relative humidity over time, when used as an output efficiency indicator. As water 20 is evaporated from the evaporative wick assembly 28, the minerals contained in the water 20 will often remain on the surface of the evaporative wick assembly 24. Minerals remaining on the surface of the evaporative wick assembly 24 reduce the wetted or working surface area of the evaporative wick assembly 24 as the evaporative wick assembly 24 ages. Since the amount of water 20 absorbed by the relatively dry room or inlet air is dependent in part upon the wetted surface area of the evaporative wick assembly 24, the difference between the measurements made by the second humidity sensor 30 and the first humidity sensor 28 will decrease proportionately with the wetted or working surface area loss. The relative humidity differential over time is calculated by the controller 32 and is used as an indicator of the age and/or deterioration of the working surface of the evaporative wick assembly 24 and the efficiency of the humidifier 10. A new evaporative wick assembly 24 generally has a large relative humidity differential, an evaporative wick assembly 24 at mid life has approximately half the relative humidity differential of a new evaporative wick assembly 24, and an evaporative wick assembly 24 at an end of life generally has little or no relative humidity differential. The controller 32 calculates the relative humidity differential of the new evaporative wick assembly 24 when the new evaporative wick assembly 24 is initially installed in the humidifier 10 and continues to calculate and record the relative humidity differential of the evaporative wick assembly 24 over time. The ratio of the new evaporative wick assembly 24 relative humidity differential to the current evaporative wick assembly 24 relative humidity differential at any time is used as an indicator of an output efficiency of the evaporative wick assembly 24. The output efficiency may be displayed to the user on a display 36 in the form of a number and/or bar graph, as a percentage verses a new evaporative wick assembly 24, or as an actual output efficiency of the humidifier 10 at any stage of a usable life of the evaporative wick assembly 24.

When used as a wick servicing indicator, the first humidity sensor 28, the second humidity sensor 30, and the controller.32 are used in much the same manner as when they are used as an output efficiency indicator. The inlet air humidity and exit air humidity are measured by the first and second humidity sensors 28, 30 and recorded by the controller 32 over time. The controller 32 indicates to the user that the evaporative wick assembly 24 needs replacement by actuating the light or LED 34 and/or the buzzer 35 if during normal operation of the humidifier 10 (i.e., water 20 is present in the water reservoir 18) the difference between the exit air humidity and the inlet air humidity approaches zero, or any predetermined output efficiency corresponding to an end of life condition for the evaporative wick assembly 24. Alternatively, if the difference between the exit air humidity and the inlet air humidity approaches zero, or any predetermined output efficiency corresponding to an end of life condition, the controller 32 may turn off the power supply 38, thereby turning off the fan assembly 26.

Figure 2:
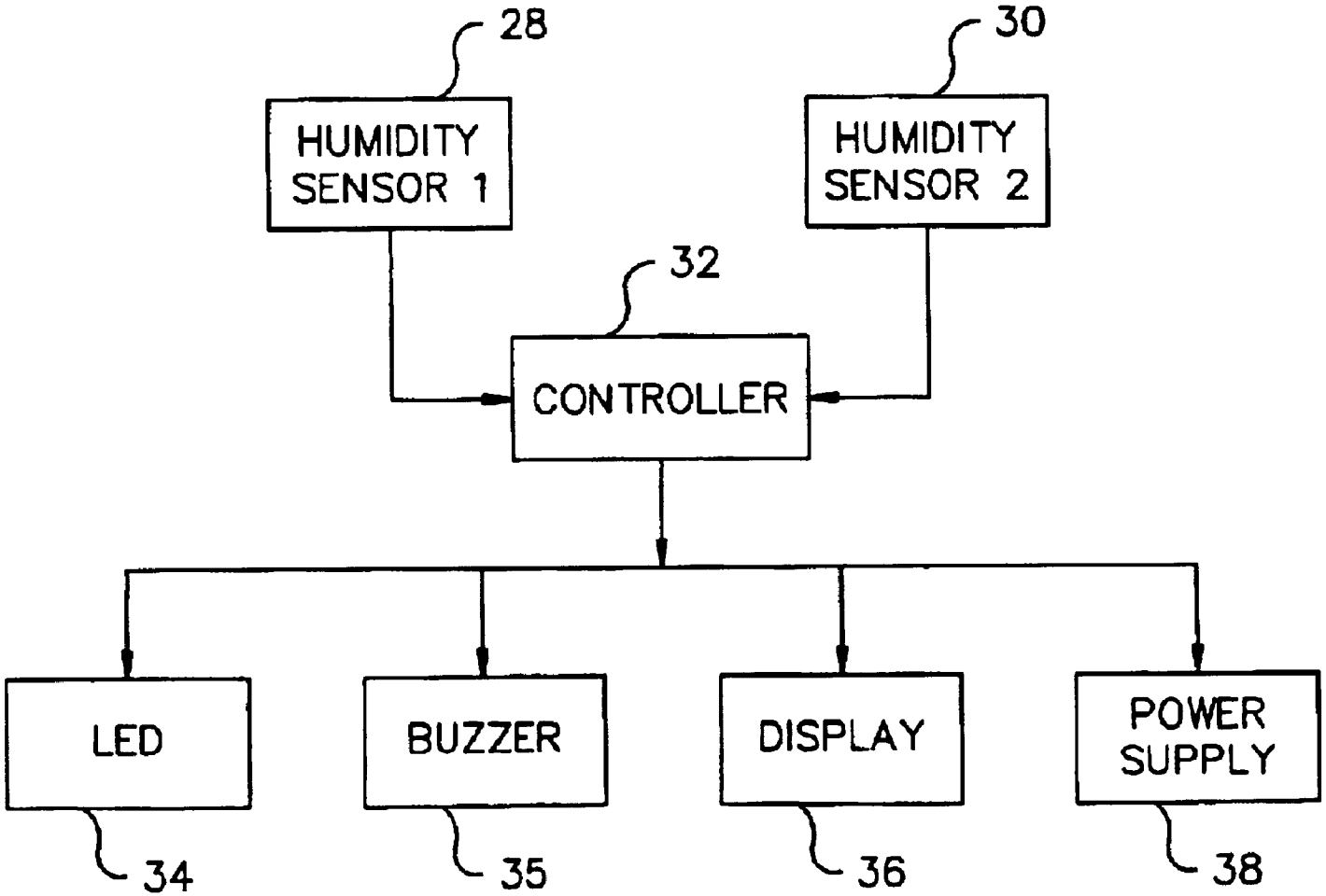
FIG. 2 is a schematic block diagram of a control system of the humidifier of FIG. 1.

One skilled in the art will realize from the above disclosure that the present invention is not limited applications involving the humidifier 10 shown in FIGS. 1 and 2. The present invention is effective for use with any humidifier, which employs an air inlet, and an air outlet where humidity of the inlet air and outlet air can be sampled. For example, the present invention is effective as an out-of water indicator, an output efficiency indicator, and a wick servicing indicator for a tank humidifier, bucket humidifier, or any like humidifier. In addition, the present invention is equally effective for use with positive or negative pressure humidifiers. Further, one skilled in the art will realize that the present invention may be used as an out-of-water indicator for a humidifier employing a non-wicking filter.

It will be appreciated by those skilled in the art that changes could be made to the embodiments described above without departing from the broad inventive concept thereof. It is understood, therefore, that this invention is not limited to the particular embodiments disclosed, but it is intended to cover modifications within the spirit and scope of the present invention.

I claim:

1. An evaporative humidifier comprising:

a housing having an air inlet, an air outlet, and a reservoir for holding water;

a fan assembly for creating an airflow through the housing from the inlet to the outlet;

a wick assembly in fluid communication with the water in the reservoir and extending into the airflow within the housing for adding moisture to the airflow;

a first humidity sensor for measuring an ambient air relative humidity and producing a first signal corresponding to the ambient air relative humidity;

a second humidity sensor for measuring an outlet air humidity and producing a second signal corresponding to the outlet air humidity; and a controller in electrical communication with the first and second humidity sensors, the controller receiving the first and second signals and performing calculations to produce an output signal.

2. The evaporative humidifier of claim 1 wherein the first humidity sensor is located proximate the air inlet.

3. An evaporative humidifier comprising:

a housing having an air inlet, an air outlet, and a reservoir for holding water;

a fan assembly for creating an airflow through the housing from the inlet to the outlet;

a wick assembly in fluid communication with the water in the reservoir and extending into the airflow within the housing for adding moisture to the airflow;

a first humidity sensor for measuring an ambient air relative humidity and producing a first signal corresponding to the ambient air relative humidity;

a second humidity sensor for measuring an outlet air humidity and producing a second signal corresponding to the outlet air humidity; and a controller in electrical communication with the first and second humidity sensors, the controller receiving the first and second signals and performing calculations to produce an output signal, wherein the controller calculates and outputs a signal indicative of an instantaneous output efficiency of the humidifier, the output signal being sent to and received by a display which displays the instantaneous output efficiency.

4. An evaporative humidifier 1 comprising:

a housing having an air inlet, an air outlet, and a reservoir for holding water;

a fan assembly for creating an airflow through the housing from the inlet to the outlet;

a wick assembly in fluid communication with the water in the reservoir and extending into the airflow within the housing for adding moisture to the airflow;

a first humidity sensor for measuring an ambient air relative humidity and producing a first signal corresponding to the ambient air relative humidity;

a second humidity sensor for measuring an outlet air humidity and producing a second signal corresponding to the outlet air humidity; and a controller in electrical communication with the first and second humidity sensors, the controller receiving the first and second signals and performing calculations to produce an output signal, wherein the controller continuously calculates an output efficiency and records output efficiencies over time to monitor degradation of the wick assembly, whereby if the output efficiency is below a predetermined value after a predetermined amount of usage of the humidifier, the controller determines and outputs an indication that a wick servicing condition exists.

5. The evaporative humidifier of claim 4 wherein the output signal is received by an indication means which notifies a user that the wick servicing condition exists.

6. The evaporative humidifier of claim 5 wherein the indication means is an audio stimulus.

7. The evaporative humidifier of claim 5 wherein the indication means is a visual stimulus.

8. The evaporative humidifier of claim 4 wherein the controller turns off the fan assembly automatically to prevent inefficient usage while the wick servicing condition exists.

9. An evaporative humidifier comprising:

a housing having an air inlet, an air outlet, and a reservoir for holding water;

a fan assembly for creating an airflow through the housing from the inlet to the outlet;

a wick assembly in fluid communication with the water in the reservoir and extending into the airflow within the housing for adding moisture to the airflow;

a first humidity sensor for measuring an ambient air relative humidity and producing a first signal corresponding to the ambient air relative humidity;

a second humidity sensor for measuring an outlet air humidity and producing a second signal corresponding to the outlet air humidity; and a controller in electrical communication with the first and second humidity sensors, the controller receiving the first and second signals and performing calculations to produce an output signal, wherein the controller continuously calculates an output efficiency and records output efficiencies over time to monitor degradation of the wick assembly, whereby if the output efficiency is below a predetermined value before a predetermined amount of usage of the humidifier, the controller determines and outputs an indication that a low liquid condition exists.

10. The evaporative humidifier of claim 9 wherein the output signal is received by an indication means which notifies a user that the low liquid condition exists.

11. The evaporative humidifier of claim 10 wherein the indication means is an audio stimulus.

12. The evaporative humidifier of claim 10 wherein the indication means is a visual stimulus.

13. The evaporative humidifier of claim 9 wherein the controller turns off the fan assembly automatically to prevent inefficient usage while the low liquid condition exists.

14. The evaporative humidifier of claim 13 wherein the controller turns off the fan assembly during the low liquid condition only when the outlet air humidity is substantially equal to the ambient air relative humidity, thereby indicating that the wick assembly is generally dry.

15. The evaporative humidifier of claim 1 wherein the output signal is received by an indication means which notifies a user that a low liquid condition exists.

16. The evaporative humidifier of claim 15 wherein the indication means is an audio stimulus.

17. The evaporative humidifier of claim 15 wherein the indication means is a visual stimulus.

18. The evaporative humidifier of claim 1 wherein the controller turns off the fan assembly automatically to prevent inefficient usage while a low liquid condition exists.

19. The evaporative humidifier of claim 18 wherein the controller turns off the fan assembly during the low liquid condition only when the outlet air humidity is substantially equal to the ambient air relative humidity, thereby ensuring that the wick assembly is generally dry.

* * * * *